US009162783B2

(12) United States Patent
Ancona et al.

(10) Patent No.: US 9,162,783 B2
(45) Date of Patent: Oct. 20, 2015

(54) APPARATUS AND METHOD FOR PRODUCING CUSTOMISED CONTAINERS OF CIGARETTES

(75) Inventors: Teresa Ancona, Nyon (CH); Michael Vincent Lewis, Essex (GB); Katrina Lewis, legal representative, Essex (GB); Oliver Pulz, Pully (CH); Bodo-Werner Lutzig, Chavornay (CH)

(73) Assignee: Philip Morris USA Inc., Richmond, VA (US)

( * ) Notice: Subject to any disclaimer, the term of this patent is extended or adjusted under 35 U.S.C. 154(b) by 926 days.

(21) Appl. No.: 12/966,634

(22) Filed: Dec. 13, 2010

(65) Prior Publication Data

US 2011/0192737 A1 Aug. 11, 2011

Related U.S. Application Data

(62) Division of application No. 11/659,840, filed as application No. PCT/GB2005/003136 on Aug. 10, 2005, now Pat. No. 7,866,127.

(30) Foreign Application Priority Data

Aug. 11, 2004 (EP) ..... 04254823

(51) Int. Cl.
*B65D 85/10* (2006.01)
*B65B 19/12* (2006.01)
*B65B 19/30* (2006.01)

(52) U.S. Cl.
CPC ..... *B65B 19/12* (2013.01); *B65B 19/30* (2013.01)

(58) Field of Classification Search
USPC ..... 53/432, 473, 444, 445, 474, 148, 151, 53/237; 206/242, 238, 236
See application file for complete search history.

(56) References Cited

U.S. PATENT DOCUMENTS 1,458,585 A * 6/1923 McCrosson ..... 206/274
1,458,586 A * 6/1923 McCrosson ..... 53/434

(Continued)

FOREIGN PATENT DOCUMENTS

DE 633413 C 7/1936
DE 8523837 U1 11/1985

(Continued)

OTHER PUBLICATIONS

International Search Report and Written Opinion mailed Feb. 8, 2006 for PCT/GB2005/003136.

(Continued)

*Primary Examiner* — Hemant M Desai
(74) *Attorney, Agent, or Firm* — Buchanan, Ingersoll & Rooney PC

(57) ABSTRACT

Cigarettes are stored in one or more reservoirs at a customer location. A computer receives customer orders and transmits them to a dispenser. Upon receipt of a customer order, a pre-selected number of cigarettes is automatically removed from the reservoir(s) by the dispenser and then automatically packed in a container by a packer comprising a collation mandrel which is movable relative to the dispenser. A preferred type of substantially air-tight, self-sealing container has a lid portion, a body portion and a collar, which is mounted within the body portion. The body portion is provided with one or more upwardly extending protrusions on the upper surface of the base thereof. An air and moisture impermeable membrane is sealed about the upper periphery of the collar.

13 Claims, 3 Drawing Sheets

(56) References Cited

U.S. PATENT DOCUMENTS

| | | | | | |
|---|---|---|---|---|---|
| 1,685,765 | A | | 9/1928 | Mangan | |
| 1,978,497 | A | * | 10/1934 | Lind | 206/259 |
| 2,072,796 | A | * | 3/1937 | Christopher | 221/260 |
| 2,786,595 | A | * | 3/1957 | Nelson | 220/212 |
| 2,812,057 | A | * | 11/1957 | Brownfield | 206/250 |
| 3,123,206 | A | * | 3/1964 | Gerber | 206/265 |
| 3,167,104 | A | * | 1/1965 | Wiley et al. | 206/259 |
| 3,190,438 | A | * | 6/1965 | Cain et al. | 206/740 |
| 3,270,486 | A | | 9/1966 | Hall | |
| 3,282,465 | A | * | 11/1966 | Davis | 221/64 |
| 3,446,338 | A | * | 5/1969 | Bozyk | 206/250 |
| 4,062,446 | A | * | 12/1977 | Oyama | 206/223 |
| 4,444,308 | A | | 4/1984 | MacEwen | |
| 4,986,416 | A | * | 1/1991 | Arthurs | 206/170 |
| 5,509,522 | A | | 4/1996 | Laidlaw | |
| 5,749,461 | A | * | 5/1998 | Guzman | 206/245 |
| 5,957,278 | A | | 9/1999 | Krawec et al. | |
| 6,130,438 | A | | 10/2000 | Torai | |
| 6,384,359 | B1 | | 5/2002 | Belcastro et al. | |
| 6,446,415 | B1 | | 9/2002 | Tale' et al. | |
| 6,499,270 | B2 | | 12/2002 | Peroni et al. | |
| 6,726,006 | B1 | * | 4/2004 | Funderburk et al. | 206/268 |
| 6,929,120 | B2 | * | 8/2005 | Zonker et al. | 206/268 |
| 7,171,796 | B2 | | 2/2007 | Spirito et al. | |
| 7,222,626 | B2 | | 5/2007 | Focke et al. | |
| 7,325,382 | B2 | | 2/2008 | Nelson et al. | |
| 7,604,008 | B2 | | 10/2009 | Gomez | |
| 7,650,730 | B2 | | 1/2010 | Bertuzzi et al. | |
| 7,684,889 | B2 | | 3/2010 | Focke et al. | |
| 7,866,127 | B2 | | 1/2011 | Ancona et al. | |
| 2008/0202540 | A1 | | 8/2008 | Carter et al. | |

FOREIGN PATENT DOCUMENTS

| | | | |
|---|---|---|---|
| DE | 10209753 | A1 | 9/2003 |
| EP | 0141629 | A1 | 5/1985 |
| FR | 2597077 | | 10/1987 |
| WO | WO95/32126 | A1 | 11/1995 |

OTHER PUBLICATIONS

International Preliminary Report on Patentability mailed Feb. 22, 2007 for PCT/GB2005/003136.

* cited by examiner

APPARATUS AND METHOD FOR PRODUCING CUSTOMISED CONTAINERS OF CIGARETTES

CROSS REFERENCE TO RELATED APPLICATION

This application is a divisional application of U.S. Application No. 11/659,840 entitled APPARATUS AND METHOD FOR PRODUCING CUSTOMISED CONTAINERS OF CIGARETTES, filed on Jun. 21, 2007 which is a national stage application under 35 USC §371 of International Application Number PCT/GB05/03136, filed Aug. 10, 2005, the International Application being published in English. This application also claims priority under 35 USC §119 to European Application No. 40254823.0, filed Aug. 11, 2004, the entire contents of each is hereby incorporated by reference.

BACKGROUND

The invention relates to an apparatus and a method for producing a customised container of cigarettes.

Cigarettes are produced and sold in a wide variety of types. For example, different types of tobacco having unique characteristic flavours and aromas, such as Burley, Oriental and Virginia tobacco, are used alone or in varying amounts in tobacco blends to produce brands of cigarettes having different characteristic flavours. In addition, both plain cigarettes and cigarettes having many different types of filter tips are manufactured as well as cigarettes of differing length, circumference, strength of flavour, total particulate matter delivery and nicotine delivery. Furthermore, cigarettes containing flavourings such as menthol are also available.

Conventionally, consumers have only been able to obtain cigarettes of a particular type by purchasing a pack containing cigarettes of that type alone. In normal production, cigarettes of a single type are placed and sealed in a pack at a factory and the finished pack is then shipped to a remote point of sale such as a vending machine or retail outlet where it is purchased by the consumer. Consequently, customers wishing to smoke different types of cigarettes on different occasions have typically had to purchase more than one pack of cigarettes.

EP-A-0 141 629 discloses a process and apparatus for producing a pack of cigarettes comprising two distinct groups of cigarettes, each group comprising cigarettes of a different type. The two distinct groups of cigarettes are dispensed from a single hopper which is divided into two compartments by a central partition, each compartment being fed with cigarettes of only one type. Groups of cigarettes dispensed from each of the two compartments of the hopper are wrapped separately before being packed together in a single conventional cigarette pack.

Although the process and apparatus described in EP-A-0 141 629 enable the production in a factory of packs comprising two different types of cigarettes, they do not enable a cigarette pack to be produced in situ at the point of sale in response to an individual order. Consequently, the process and apparatus described in EP-A-0 141 629 still suffer from the disadvantage that they do not allow the contents of a container of cigarettes to be tailored or customised in accordance with an individual customer's particular tastes or requirements.

SUMMARY

According to the invention there is provided apparatus for the production of a customised container of cigarettes at a customer location, the apparatus comprising: a reservoir for storing cigarettes at the customer location; a dispenser for automatically removing a pre-selected number of cigarettes from the reservoir at the customer location in response to a customer order; computing means adapted to receive a customer order at the customer location and to transmit the customer order to the dispenser; and a packer for automatically packing the removed pre-selected number of cigarettes into a container at the customer location.

According to the invention there is also provided a method of producing a customised container of cigarettes at a customer location comprising: providing a reservoir of cigarettes at the customer location; automatically removing a pre-selected number of cigarettes from the reservoir in response to a customer order; and packing the removed pre-selected number of cigarettes into a container.

The term customer location is used throughout the specification to mean any point of disposal of cigarettes to a consumer whether by sale or otherwise, such as, for example, a cigarette kiosk, brand store, duty free shop or other point of sale, or a hospitality lounge, promotional stand or other point of distribution.

Preferably, the apparatus of the invention comprises two or more discrete reservoirs for storing cigarettes at the customer location, each reservoir being separately provided with means for supplying cigarettes thereto. Preferably, each reservoir is. separately provided with means of supplying cigarettes of a single type thereto. If desired, however, one or more of the plurality of reservoirs may be provided with means for supplying a mixture of two or more different types of cigarette thereto to allow a customer to order a container completely or partially filled with an unspecified assortment or "lucky dip" of cigarettes types. It will be appreciated that for the purposes of the present invention, two or cigarettes may be regarded as being of different types if they differ in, for example, one or more of the ways discussed in the opening paragraphs of the specification.

Preferably, each reservoir of the apparatus of the invention is provided with one or more removable cartridges for supplying cigarettes thereto. The reservoir(s) may be, for example, hoppers or any other receptacle suitable for storing cigarettes. Preferred embodiments of the apparatus of the invention include up to 10 discrete reservoirs.

Preferably, where the apparatus of the invention comprises two or more discrete reservoirs, the two or more discrete reservoirs are adapted to move relative to the dispenser.

By producing individual containers of cigarettes automatically on demand at a customer location, the method and apparatus of the invention allow a customer to order a container holding a desired number of cigarettes. Furthermore, through the provision of a plurality of discrete reservoirs of cigarettes at the customer location, embodiments of the method and apparatus of the invention also allow a customer to order a container holding desired quantities of two or more different types of cigarette. Since, in contrast to the process and apparatus described in EP-A-0 141 629, the method and apparatus of the invention enable a pack to be produced in situ at the point of sale or distribution in response to an individual order or request, they allow the contents of a container of cigarettes to be tailored or customised in accordance with an individual customer's particular tastes or requirements.

Preferably, the packer of the apparatus of the invention further comprises means for sealing the container, more preferably the packer comprises means for sealing the container under at least a partial vacuum. By sealing the customised container of cigarettes under at least a partial vacuum, embodiments of the apparatus and method of the invention advantageously maintain the freshness of the cigarettes therein prior to opening of the container by the consumer.

To provide visual interest to customers, the apparatus of the invention is preferably at least partially formed from transparent material(s). At least partial formation of the reservoir (s) of the apparatus from transparent material advantageously enables customers to see the variety of cigarettes on offer and to inspect their quality before placing an order. In addition, at least partial formation of the remainder of the apparatus from transparent material advantageously allows customers to watch ordered customised containers of cigarettes being produced. It will be appreciated, however, that the apparatus of the invention may also be formed from opaque or semi-transparent materials and/or that opaque or semi-transparent manufacturer or brand logos; trade marks, slogans or other indicia may be applied to the external surface thereof.

Preferably, the apparatus of the invention further comprises storage means for storing a plurality of containers at the customer location. More preferably, the apparatus of the invention further comprises storage means for storing two or more different types of container at the customer location. Preferably, the packer comprises means for automatically removing a container of a pre-selected one of the two or more different types from the storage means in response to the customer order. The different types of container may be made from one or more different materials, such as cardboard, plastic or metal, and/or be of different size and/or cross-section, such as rectangular, square, oval, round or triangular.

By providing a plurality of different types of container at the customer location, embodiments of the method and apparatus of the invention advantageously allow a customer to select a container of a desired type. For example, individually customised containers of ten or twenty cigarettes as well as hinged lid, rounded corner and oval containers of cigarettes may be produced at a customer's request by embodiments of the method and apparatus of the invention.

Preferably, the computing means of the apparatus of the invention is provided with a pre-programmed set of customer orders for selection by the customer. For example, the computing means may comprise a terminal for receiving customer orders that offers a number of pre-programmed combinations of container type, size and shape and/or quantities and type of cigarette for the customer to select using an interactive touch screen.

The arrangement of a bundle of cigarettes for packaging is commonly referred to as a collation. Preferably, the packer of the apparatus of the invention comprises a collation mandrel for receiving cigarettes removed from the reservoir by the dispenser at the customer location, the collation mandrel being adapted to move relative to the dispenser. In use, a collation of cigarettes is formed in the collation mandrel and then packed into a container.

A preferred substantially air-tight, self-sealing container for use with apparatus and method of the invention comprises a lid portion, a body portion and a collar, mounted within the body portion, having a substantially air and moisture impermeable membrane affixed to the upper surface thereof.

In use, the collar of the preferred container surrounds the upper ends of the cigarettes therein. Where the preferred container comprises two or more different types of cigarette, the interior of the collar is preferably divided into two or more compartments, each of which, in use, contains cigarettes of only one of the two or more different types.

Preferably, the preferred container comprises means mounted at the base of the body portion for raising the upper end of one or more of the cigarettes in the container relative to the upper ends of other cigarettes therein. Elevation of one or more of the cigarettes in the container relative to the other cigarettes therein advantageously enables the customer to easily remove the elevated, cigarettes from the container.

The substantially air and moisture impermeable membrane may be affixed to the upper surface of the collar by a re-sealable adhesive.

Customised containers of cigarettes produced by the method and apparatus of the invention may be marked with an identification mark, such as a bar code or graphic symbol, to identify each customised container of. cigarettes produced with a particular customer or customer order.

BRIEF DESCRIPTION OF THE DRAWINGS

The invention will be further described by way of example with reference to the accompanying drawings in which.

DETAILED DESCRIPTION

Figure 1:
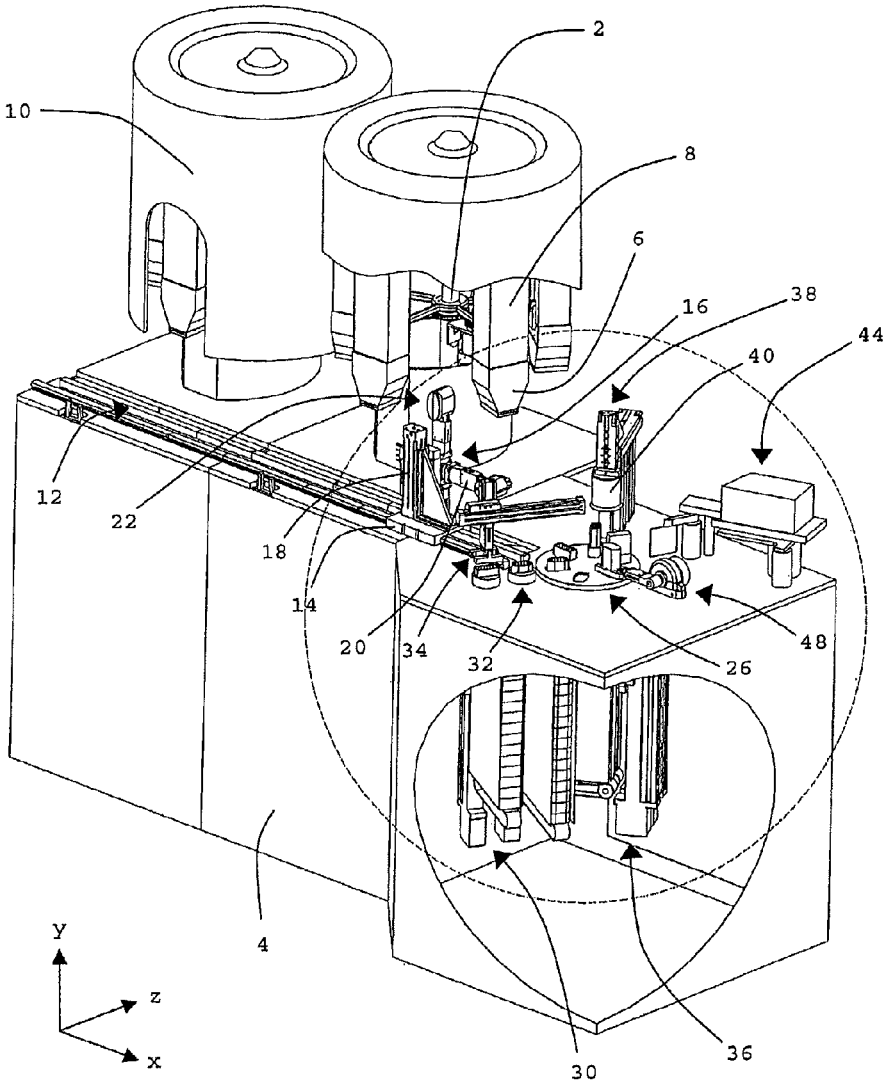
FIG. 1 shows a perspective view of apparatus for producing a customised pack of cigarettes according to the invention.

The apparatus according to the invention shown in FIG. 1 comprises a pair of adjacent five-station indexing dispensing carousels 2, which are mounted for rotation about a pair of parallel vertical axes on the horizontal upper surface of an enclosed frame 4. Five, equally spaced, vertical hoppers 6 are mounted around the lower periphery of each dispensing carousel 2 at the five stations thereof, such that the longitudinal axes of the hoppers 6 lie parallel to the axis of rotation of the dispensing carousels 2. Five equally spaced elongate removable cartridges 8 are mounted around the upper periphery of each dispensing carousel 2, directly above the five hoppers 6, such that the longitudinal axes of the cartridges 8 also lie parallel to the axis of rotation of the dispensing carousels 2.

The cartridges 8 are closed at their lower end by a pair of interlocking flaps and are filled with cigarettes using separate apparatus (not shown), which may advantageously be installed at a remote cigarette production facility, and then manually mounted on the dispensing carousels 2 at the customer location by an operator. Each filled cartridge 8, which may be made from a transparent material such as polyethylene terephthalate (PET), is preferably separately, over wrapped with an air and moisture impermeable material, such as orientated polypropylene (OPP) that is removed. by the operator at the customer location before the cartridge 8 is mounted on the dispensing carousel 2.

The maximum number of cigarettes each cartridge 8 may contain is, of course, determined by the dimensions of the cartridge 8. 100 mm wide by 90 mm deep by 250 mm high cartridges may, for example, be employed where the maximum capacity of the cartridges 8 is desired to be about 1000 conventional size cigarettes.

The ten hoppers 6 of the apparatus shown in FIG. 1 are identical to one another and of known configuration. Each hopper 6 is closed off at the base and has side walls that taper inwards from top to bottom. The lower portion of each hopper 6 is divided into a number of generally upwardly extending channels by a set of spaced apart vanes (not shown). The spacing between adjacent vanes, and hence the width of each channel, is slightly greater than the diameter of a single cigarette so that cigarettes with their longitudinal axes aligned horizontally, descending vertically through the hopper 6 from the cartridge 8, stack up in single columns on the base thereof within the channels. Oscillating agitators (not shown) are mounted above the vanes within each hopper 6 to ensure regular flow of cigarettes through the hopper 6 into the channels.

Each hopper 6 additionally comprises means (not shown) for automatically opening the interlocking flaps at the lower end of a cartridge 8, once the cartridge 8 has been mounted above it on the dispensing carousel 2, to allow the cigarettes contained therein to fall under gravity through the hopper 6 into the channels formed between the vanes thereof.

Figure 2:
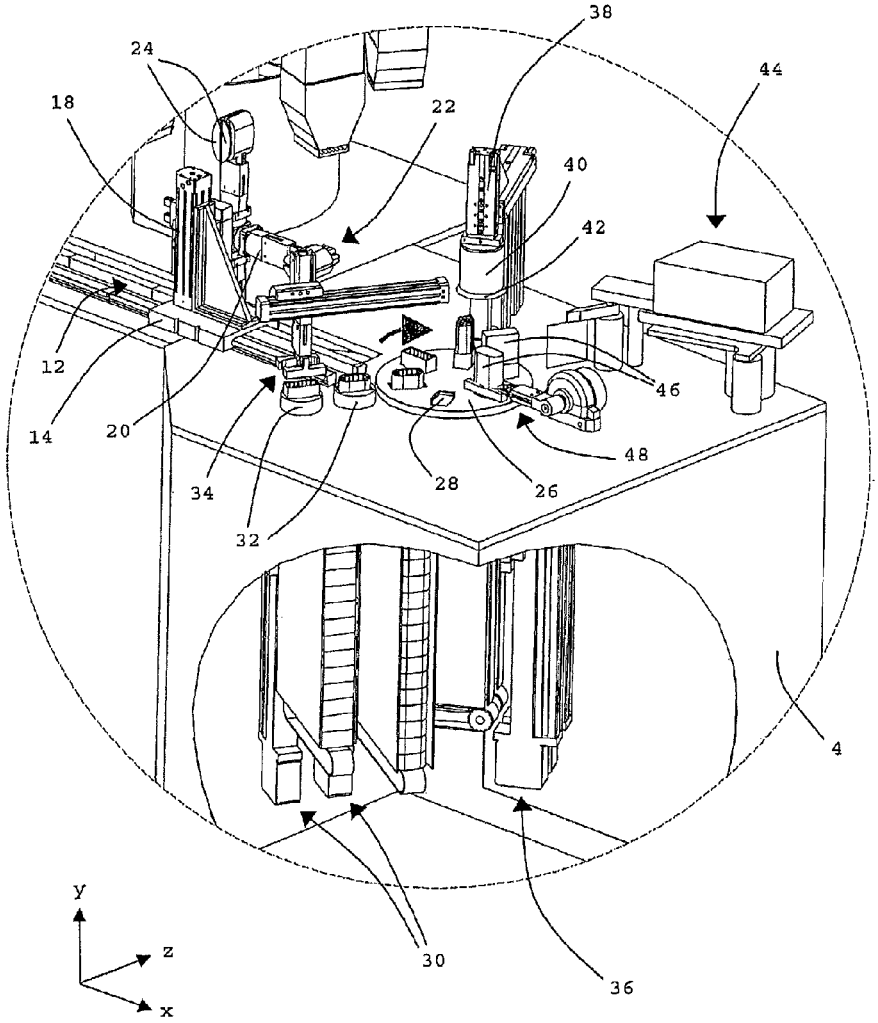
FIG. 2 shows an enlarged perspective view of the circled portion of the apparatus of FIG. 1.

Each dispensing carousel 2 with its associated five hoppers and five cartridges 8 is housed in a cabinet 10, the temperature and humidity within which is regulated by the control. system (not shown) of the apparatus. In addition to regulating the temperature and humidity within the cabinets 10, the control system also regulates and transforms incoming power to the apparatus to the appropriate levels required by the power and logic systems therein. To show the position of the hoppers 6 and cartridges 8 on the dispensing carousels 2, the lower part of the cabinet 10 surrounding one dispensing carousel 2 of the apparatus shown has been removed in FIG. 1. In preferred embodiments, the cabinets 10 and hoppers 6 of the apparatus shown in FIGS. 1 and 2 are made substantially from transparent material to provide visual interest to customers and the cabinets 10 contain a lighting system to improve the visibility of the contents thereof.

Three sets of detectors (not shown), which are coupled to the control system of the apparatus, are also housed in each cabinet 10. The first set of detectors comprises five separate detectors mounted at each station of the dispensing carousel 2 of a known type capable of reading a bar code or other identifying mark applied to the external surface of an article. The first set of detectors are mounted proximate the top of each of the five cartridges 8 mounted on the dispensing carousel 2 and, in use, read identifying marks applied to the rear of each cartridge 8 which identify the type of cigarettes contained therein. During production, the control system of the apparatus uses this information to drive the indexing dispensing carousel 2 to the correct position to dispense cigarettes from a hopper 6 supplied by a cartridge 8 containing the type of cigarettes ordered by a customer. The control system thereby ensures that even where, a cartridge 8 containing an incorrect type of cigarettes has been loaded at a particular station on the dispensing carousel 2 by an operator, the cigarettes dispensed from the dispensing carousel 2 to form the customised container are of the type or types ordered by the customer.

The second set of detectors also comprises five separate detectors, one of which is mounted inside the upper portion of each of the five hoppers 6 on the dispensing carousel 2. The second set of detectors may comprise any known type of detector capable of sensing whether the channels between the vanes of the hoppers 6 are full, such as, for example, a standard weighted pivoting finger system.

Finally, the third set of detectors comprises a plurality of detectors mounted in the channels between the vanes of the five hoppers 6, which are of a known type capable of sensing the absence of an article or the presence of a defective article. In use, the third set of detectors inspect the tobacco end of cigarettes passing between the vanes of the hoppers 6 for loose ends and/or the filter ends of the cigarettes for discolouration or the absence of a filter. Preferably, the third set of detectors comprises optical detectors that measure the light reflected from the ends of the cigarettes.

The apparatus of FIG. 1 further comprises a ball screw slide way 12, mounted in front of the two dispensing carousels 2 on the upper surface of the frame 4, on which a carriage 14. is mounted for horizontal movement in the X-direction relative to the dispensing carousels 2. A four-station rotary indexing turret 16 is mounted for vertical movement in the Y-direction on a vertical slide way 18 that is fixedly mounted on the carriage 12. Four arms radial arms 20 are spaced at 90° intervals around the turret, which is mounted for rotation about a horizontal axis perpendicular to the direction of movement of the carriage 14.

A hollow, elongate split mandrel 22 is mounted on the end of each arm 20 of the turret 16 by a 90° rotating valve, for independent rotational movement between a first position in which the longitudinal axis of the split mandrel 22 is horizontal, perpendicular to the direction of movement of the carriage 14, and a second position in which the longitudinal axis of the split mandrel 22 is vertical. For simplicity, in FIGS. 1 and 2 only two arms 20 and associated split mandrels 22 of the apparatus are shown. It will be appreciated, however, that the general construction and mode of operation of the other two arms and associated split mandrels of the apparatus are identical to those of the arms 20 and split mandrels 22 shown. With reference to FIG. 2, each split mandrel 22 comprises a pair of hinged jaws 24 with a profiled inner surface, which may be opened and re-closed, independently of the jaws 24 of the remaining split mandrels 22, by a mechanism and electrical actuator (not shown).

Horizontal, reciprocating inserter rods (not shown), equal in number to the number of channels in the lower portion of each of the hoppers 6, are mounted for movement in the Z-direction at the front station of each indexing dispensing carousel 2 proximate the ball screw slide way 12. The inserter rods are mounted between each dispensing carousel 2 and the rear of the hopper 6 at the front station thereof, in line with the transverse axes of the channels of the hopper 6. When actuated by, for example, a servo motor, a reciprocating inserter rod pushes the bottom most or final cigarette in a column of cigarettes in one of the channels of the hopper 6 along its longitudinal axis towards the slide way 12. So that, in use, the reciprocating inserter rods push on the filter end, rather than the tobacco end, of filter cigarettes, cartridges 8 containing filter cigarettes are mounted on the dispensing carousel 2 with the filter ends of the cigarettes radially inward and the tobacco ends radially outward.

The way in which a number of parallel cigarettes must be grouped together or collated in order to fit within a particular container depends upon the cross-sectional shape of that container. For example, in a conventional, rectangular hinge-lid pack of twenty cigarettes the cigarettes are arranged in a nested 7-6-7 collation, while in an oval hinge-lid pack of twenty cigarettes the cigarettes are arranged in a 4-6-6-4 collation.

In use, rows of cigarettes pushed clear of the vanes of the hoppers 6 of the apparatus of FIGS. 1 and 2 by the reciprocating inserter rods of the apparatus of FIGS. 1 and 2 are received by the split mandrels 22, which are positioned in line with the inserter rods at the front station of the dispensing carousels 2 by the ball screw slide way 12, vertical slide way 18 and turret 16, to form collations of cigarettes which are then packed into individual containers of corresponding cross-sections. The number of channels in each hopper 6, and hence the number of inserter rods mounted at the front station of each dispensing carousel 2 is equal to, or greater than, the maximum number of cigarettes in any row of the collations formed by the four split mandrels 22. For example, where all of the split mandrels 22 of the apparatus of FIGS. 1 and 2 are configured to form a 7-6-7 collation of twenty cigarettes for insertion into a conventional, rectangular hinge-lid pack, each hopper 6 has at least seven channels and a corresponding number of inserter rods are mounted at the front station of each dispensing carousel 2. The inserter rods are coupled to one another and the control system of the apparatus so that they may be actuated together as a group or in a number of sub-groups, each of which contains a different number of adjacent inserter rods. The number of inserter rods in each sub-group is equal to the number of cigarettes in a row of a collation of cigarettes formed by the split mandrels 22.

By way of example only, it will be assumed that, in use of the apparatus of FIGS. 1 and 2, customers may order four different types of container, each having a different cross-section, and that the inner surfaces of the jaws 24 of the four split mandrels 22 of the apparatus are profiled to closely match four different collations of cigarettes, corresponding to the four different cross-sections of the containers.

By way of example only, it will also be assumed that the customer may also choose from five different brands of filter cigarette and that each dispensing carousel 2 has cartridges 8 containing these five brands of cigarettes mounted thereon.

In use, a customer selects a container from the four different types available and then selects the brand of filter cigarette they want in each row of the required collation of cigarettes for a container of that cross-section. Following receipt of the customer order, the turret 16 is indexed by the control system until the longer transverse axis of the split mandrel 22 with jaws 24 having a profiled inner surface closely matching the collation corresponding to the cross-section of the selected container is horizontal. The ball screw slide way 12 is then driven under computer control to move this split mandrel 22 in front of one of the cabinets 10, while the vertical slide way 18 is motor driven to align the inner profiled surface of the lower jaw 24 of the split mandrel 22 with the inserter rods at the front station of the dispensing carousel 2 therein.

Once the split mandrel is in position, the reciprocating inserter rods are actuated as a group or sub-group to push a first row of cigarettes, containing a number of cigarettes equal to that in the first row of the required collation, from the bottom of the columns in the channels of the hopper 6 along their longitudinal axis out of the vanes and into the split mandrel 22. Once the row of cigarettes has been inserted and the inserter rods retracted to their starting positions, the columns of cigarettes in the channels of the hopper 6 move down under gravity so that the penultimate cigarettes in the columns come into alignment with the inserter rods.

The vertical slide way 18 and, where necessary, ball screw slide way 12 are then driven under computer control to line the split mandrel 22 up in the correct position relative to the inserter rods to receive the next row of the collation of cigarettes required for the container of cigarettes ordered by the customer. Once the split mandrel 22 is in position, the inserter rods are actuated as a group or sub-group to insert a second row of cigarettes, containing a number of cigarettes equal to that in the second row of the required collation, from the hopper 6 into the split mandrel 22 on top of the first row of cigarettes therein. The steps of repositioning the split mandrel 22 relative to the inserter rods and actuating the inserter rods to push a row of cigarettes into the split mandrel 22 are repeated until the split mandrel 22 contains the complete collation of cigarettes required for the container of cigarettes ordered by the customer. Thus, in use, the inserter rods are static in the X-Y plane, but move in the Z-direction, while the split mandrels 22 are moved in the X-Y plane.

Depending upon the preceding customer order, the hopper 6 and cartridge B containing cigarettes of the correct type for the first row of the collation required for the customer order may not initially be at the front station of the dispensing carousel 2. Similarly, where the customer has ordered a container of cigarettes comprising two different types of cigarette, the cigarettes in one or more adjacent rows of the required collation will inevitably be of different types. In this case, before the inserter rods are actuated to insert the first row of cigarettes, or second of two dissimilar adjacent rows of cigarettes, into the split mandrel 22, the dispensing carousel 2 is indexed under computer control until a hopper 6 and cartridge 8 containing cigarettes of the correct type for the respective row is at the front station of the dispensing carousel 2.

It will be appreciated that if, for example, the ten hoppers 6 mounted on the two dispensing carousels 2 were to contain more than five different types of cigarettes, the hoppers 6 containing the correct type of cigarettes for two dissimilar adjacent rows in any required collation might be mounted on different dispensing carousels 2. In this case, before the second of the two dissimilar adjacent rows is inserted into the split mandrel 22, the ball screw slide way 12 and vertical slide way 18 are also driven to move the split mandrel 22 from one dispensing carousel 2 to the other. The inserter rods associated with the latter dispensing carousel 2 are then actuated to push the cigarettes forming the second of the two dissimilar adjacent rows into the split mandrel 22.

Similarly, if a second detector in a hopper 6 supplied by a cartridge 8 containing the correct type of cigarettes for the next row of the required collation has informed the control system of the apparatus that the vanes of that hopper 6 are not full, the ball screw slide way 12 may be driven to move the split mandrel 22 between the dispensing carousels 2 and/or the dispensing carousels 2 may be indexed to position the split mandrel 22 before a dispensing carousel 2 having an alternative hopper 6 having vanes filled with the same type of cigarettes at the front station thereof.

As the columns of cigarettes formed between the vanes of the hoppers 6 are fed under gravity down through the channels, the third set of sensors inspect the tobacco and filter end of each cigarette therein. If the third set of detectors identifies a defect at either end of a cigarette, the control system of the apparatus records the position of the defective cigarette. When, in response to a customer order, a row of cigarettes containing the defective cigarette is pushed out of the channels of whopper 6 at the front station 2 of a dispensing carousel 2 by the reciprocating inserter rods, the control system interrupts the collation forming process and instructs the ball screw slide way 12 to move the carriage 14 away from the front station of the carousel 2, so that the row of cigarettes is not inserted into the split mandrel 22, but falls into a reject tray or chute. Once the row of cigarettes containing the defective cigarette has been rejected in this way, the control system instructs the ball screw slide way 12 to drive the carriage 14 back to the front station of the dispensing carousel 2 so that a row of non-defective cigarettes may be inserted from the hopper 6 into the split mandrel 22 by the inserter rods.

To avoid the need to reject a whole row of cigarettes in order to remove a single cigarette identified as defective by the third set of detectors, the apparatus of FIGS. 1 and 2 may be provided with reciprocating inserter rods that can be actuated independently of one another. Alternatively, means may be provided for emitting blasts of compressed air separately from the ends of the reciprocating inserter rods in order to reject individual defective cigarettes.

Once the collation is complete, the ball screw slide way 12 is driven under computer control to move the carriage 14 to one end thereof, where, as described below, the split mandrel 22 transfers the complete collation of cigarettes to the first station of a horizontal, indexing turntable 26 mounted on the upper surface of the frame 4 at the end of the ball screw slide way 12.

As shown in FIG. 2, six recesses 28 are equally spaced in the upper surface of the turntable 26, around the circumference thereof, such that the principal axes of the recesses 2B are radial of the turntable 26. In use, the turntable 26 indexes around clockwise as shown in FIG. 2 by the arrow, through six stations at which and between which packing operations take place, as described below.

At the first station, immediately upstream of the end of the slide way 12, four vertical magazines 30, each containing pre-formed lids for one of the four types of container selectable by the customer, are mounted about the periphery of the turntable 26, beneath the upper surface of the frame 24. In FIGS. 1 and 2 a portion of the sides of the frame 4 has been removed to show the position of two magazines 30; for the sake of simplicity the other two magazines have been omitted from the Figures. A separate aperture 32 in the upper surface of the frame 4 is located above each of the four magazines 30, through which upside down pre-formed lids are automatically delivered by the magazine 30. For the sake of simplicity only two of the four apertures 32 are shown in FIGS. 1 and 2. Preferably, the inner surface of the pre-formed lids is profiled to match the collation of cigarettes On the upper surface of the frame 4 at the first station of the turntable 26, proximate the apertures 32, an extendable vertical gripper arm 34 is mounted for radial movement relative to the turntable 26. Following receipt of the customer order by the control system of the apparatus, the gripper arm 36 is actuated by, for example, a servo motor and driven under computer control to a position over the aperture 32 above the magazine 30 containing pre-formed lids for the type of container ordered by the customer. Once in position, the gripper arm is extended to remove a pre-formed lid from the aperture 32 and then retracted. The gripper arm 34 and removed pre-formed lid are driven radially to a position over the turntable 26 where the gripper arm 34 is extended to place the lid upside down in an empty recess 28 in the turntable 26 at the first station.

The turntable 26 indexes clockwise to move the upside down lid downstream to the second station, at the end of the ball screw slide way 12, where it receives the collation of cigarettes from the split mandrels 22. The split mandrel 22 is driven by the ball screw slide way 12 to a position over the upside down lid at the second station and the 90° rotating valve, by which the split mandrel 22 is mounted to the arm 20 of the turret 16, is actuated to move the split mandrel 22 to the second position in which the longitudinal axis thereof, and hence of the collation of cigarettes therein, is vertical. Where, as in the present example, the split mandrel 22 contains a collation of filter cigarettes, the 90° rotating valve is operated so that when the split mandrel 22 is in the second position the filter ends of the cigarettes are nearest the frame 4.

Once the split mandrel 22 is in the second position, the vertical slide way 18 is driven to move the turret 16 and split mandrel 22 in the Z-direction towards the turntable 26 so that the collation of cigarettes is inserted filter end first into the upside down lid. The jaws 24 of the split mandrel 22 are then hinged opened to release the collation of cigarettes and the vertical slide way 18 driven to raise the split mandrel 22 clear thereof. A first horizontal gripper arm (not shown), which is fixedly mounted on the turntable 26, is operated to grasp the collation of cigarettes just before it is released by the split mandrel 22. The first horizontal gripper arm maintains its grip. on the collation as the pre-formed container lid in which it is held is moved further downstream from the second station to the third station by the indexing turntable 26.

Meanwhile, the jaws 24 of the split mandrel 24 are closed and the 90° rotating valve operated to return the split mandrel 22 to the first position, in which the longitudinal axis of the split mandrel 22 is horizontal. The control system then drives the ball screw slide way 12, vertical slide way 18 and turret 16, as required, to position the correct split mandrel 22 for the following customer order in front of one of the dispensing carousels 2 and the filing process described above is recommenced.

At the third station, four additional vertical magazines 36, each containing pre-formed bodies for one of the four types of container selectable by the customer, are mounted about the periphery of the turntable 26, beneath the upper surface of the frame 24. A separate additional aperture (not shown) in the upper surface of the frame 4 is located above each of the four magazines 36, through which upside down pre-formed bodies are automatically delivered by the magazine 36. For the sake of clarity not all of the additional magazines 36 have been included in FIGS. 1 and 2. A moveable cartridge or cassette mounted beneath a single aperture in the upper surface of the frame 4 may alternatively be employed in the apparatus of FIGS. 1 and 2 to hold the pre-formed lids and/or pre-formed bodies for each type of available container, rather than the plurality of separate vertical cartridges 30, 36 and separate apertures 32 and additional apertures.

An extendable vertical arm 38 is mounted on the upper surface of the frame 4 at the third station for radial movement relative to the turntable 26. On the end of the vertical arm 38, a cylindrical vacuum chamber 40 having a circumferential O-ring seal 42 disposed at its base is mounted for movement in the Z-direction. A pneumatic vertical pusher (not shown) with a suction head as also mounted on the end of the vertical arm 38, within the vacuum chamber 40, for independent movement in the Z-direction relative thereto. The vertical arm 38 is actuated by, for example, a servo motor, and driven under computer control to position the vacuum chamber 40 and pusher over the additional aperture above the additional magazine 36 containing pre-formed bodies for the type of container ordered by the customer. Once in position the pusher is extended to place the suction head on the base of a pre-formed container body, which is removed from the additional aperture as the pusher is retracted. Following retraction of the pusher, the arm 38 is driven radially to move the vacuum chamber 40 and removed pre-formed container body to a position over the turntable 26.

Once in position, the vertical arm 38 is extended to lower the vacuum chamber 40 onto the upper surface of the turntable 26 and the pusher therein is extended to lower the upside down preformed body over the collation of cigarettes held in the preformed lid in the recess 28 in the turntable 26 at the third station. As the vacuum chamber 40 and body of the container are lowered over the collation of cigarettes, the collation is released by the first horizontal gripper arm mounted on the turntable 26.

Just before the pre-formed body is placed by the pusher onto the upside down pre-formed lid at the third station, the air within the vacuum chamber 40 is evacuated through a pipe in communication with the top of the vacuum chamber 40 and/or through an aperture in the turntable 26 beneath the vacuum chamber 40. Once the pre-formed body has been placed onto the pre-formed lid at the third station, sealing the collation of cigarettes within the container, the vacuum inside the vacuum chamber 40 and the vacuum applied to the suction head of the pusher, are released, the pusher retracted and the vertical arm 40 retracted to raise the vacuum chamber 40 clear of the sealed container 46.

As the turntable indexes further clockwise, the sealed container of cigarettes 46 formed at the third station is moved downstream to a fourth station where an automatic printing and labeling system 44 is mounted on the upper surface of the frame 4, next to the turntable 26. The printing and labeling system 44 is actuated by the control system to generate a label showing information concerning the quantity and type of cigarettes within the container and identifying the customer order, which is then applied by the system 44 to the surface of the container 46 at the fourth station. The label applied to the container 46 may simply identify the customer order using a unique identification number assigned to the order by the control system. Preferably, however, when ordering the customised container of cigarettes the customer also enters a personalised graphic or verbal identifier at the terminal, which is then printed on the label by the system 46. The software displayed by the touch screen of the terminal may, for example, include a sub-menu that presents the customer with a choice of pre-programmed graphic symbols for selection and/or which allows the customer to enter their name or initials.

Once the label has been applied to the container 46 by the automatic printing and labeling system 44, the turntable 26 indexes clockwise to move the container 46 downstream from the fourth station to the fifth station where it is removed from the turntable 26 and placed the right way up on the upper surface of the frame 4 for delivery to the customer. A second horizontal gripper arm 48 is mounted on the upper surface of the frame 4, about the periphery of the turntable 26 at the fifth station, for rotational movement about a transverse axis. As it reaches the fifth station, the container 46 is grasped by the second horizontal gripper arm 48, which is then rotated by 180° about the transverse axis to place the container 46 the right way up on the upper surface of the frame 4. The upright container 46 is released by the second gripper arm 48 and delivered to the customer manually by the operator of the apparatus or automatically by means not shown.

Downstream of the second horizontal gripper arm 48, the apparatus shown in FIGS. 1 and 2 may further comprise, for example, an additional automatic printing and labeling system (not shown) for applying a tax stamp to the container 46 and/or a wrapper for applying a transparent over wrap to the container 46.

The entire apparatus shown in FIGS. 1 and 2 is preferably mounted behind a counter or bar (not shown) upon which, for example, video screens may be mounted to advantageously display advertisements and/or other information to customers. A customer preferably places their order using a graphical touch screen system at a terminal mounted on the counter or bar.

The apparatus shown in FIGS. 1 and 2 is preferably operated by the control system at a speed which is sufficiently slow to allow the customer to follow the individual manufacturing processes described above during production of their ordered customised container of cigarettes. Depending upon the volume of customer orders received, the control system may, however, adjust the speed of the apparatus to ensure that length waiting times, which could result in a loss of customer interest, are avoided. Preferably, the speed at which the apparatus is operated is such that the time taken to produce each customised container of cigarettes is between 30 seconds and 2 minutes.

To increase the operating capacity of the apparatus of FIGS. 1 and 2, that is the length of time for which the apparatus may operate before empty cartridges 8 on the dispensing carousels 2 must be manually replaced by an operator, an eight-station, indexing reservoir carousel may be mounted above each dispensing carousel 2 for independent rotation about the same vertical axis as the dispensing carousel 2. In use, additional, equally spaced, filled "stock" cartridges are mounted on each of the two reservoir carousels at the seven stations thereof, leaving one station on each reservoir carousel empty.

When a second detector in a hopper 6 senses that the channels between the vanes of that hopper 6 are empty, the control system instructs the dispensing carousel 2 on which the empty hopper 6 is located, and/or the reservoir carousel mounted above that dispensing carousel 2, to index until the empty hopper 6 is positioned directly below the empty station on the reservoir carousel. Once in position, the control system actuates a transfer mechanism mounted on the reservoir carousel that includes, for example a reciprocating suction head, which removes the cartridge 8 mounted above the empty hopper 6 and raises it into the empty station on the reservoir carousel. The dispensing carousel 2 on which the empty hopper 6 is located and/or the reservoir carousel are then indexed by the control system until an additional cartridge on the reservoir carousel containing the same type of cigarettes as the removed cartridge 8 is positioned directly above the empty hopper 6. Once in position, the same or a corresponding transfer mechanism is actuated by the control system to lower the additional cartridge onto the dispensing carousel 2 above the empty hopper 6.

Either a single transfer mechanism, located at a particular station of the reservoir carousel, or a plurality of identical transfer mechanism, located at each station of the reservoir carousel, may be provided for replacing cartridges 8 on the dispensing. carousel 2 with additional cartridges from the reservoir carousel. Furthermore, the content of the seven additional "stock" cartridges on the reservoir carousel may advantageously be matched to customer demand. For example, if customers show a preference for two of the five cigarette brands available from each of the dispensing carousels 2, two additional cartridges containing each of the two preferred brands of cigarette may be mounted on each reservoir carousel, together with a single additional cartridge containing each of the other three brands.

To ensure that an additional cartridge containing the correct type of cigarettes is lowered from the reservoir carousel into position above an empty hopper 6, a detector that reads identifying marks applied to the rear of an additional cartridge is preferably mounted at each station of the reservoir carousel. Such detectors may be provided instead of, or in addition to, the first set of detectors already described.

In the embodiment of the apparatus of the invention shown in FIGS. 1 and 2, two five-station indexing dispensing carousels are provided. In alternative embodiments, three or more indexing dispensing carousels, or a single dispensing carousel, having an increased or reduced number of stations may be provided. Furthermore, instead of, or in addition to, multi-station dispensing carousels, embodiments of apparatus according to the invention may comprise two or more, spaced apart, fixed vertical hoppers between which the carriage 14 carrying the split hoppers 22 is moved by the ball screw slide way 12. Where the apparatus of the invention comprises a plurality of spaced apart, fixed hoppers, an indexing multi-station carousel is preferably mounted above each fixed hopper on which a plurality of filled cartridges of cigarettes may be mounted in order to increase the operating capacity of the apparatus.

During production of a customised container of cigarettes on the apparatus shown in FIGS. 1 and 2, a collation of cigarettes is placed filter end first into an upside down pre-formed lid dispensed from a magazine 30 and then an upside down pre-formed body dispensed from an additional magazine 36 placed over the collation of cigarettes, onto the upside down lid, to form the customised container of cigarettes. It will be appreciated, however, that the customised container of cigarettes could alternatively be formed by, for example, similarly placing the collation of cigarettes tobacco end first into a pre-formed body dispensed from a magazine and then placing a pre-formed lid dispensed from a magazine over the collation of cigarettes, onto the body.

The collation of cigarettes for insertion into the container may be formed by removing rows of cigarettes, corresponding to the longitudinal rows of the collation, one at a time from the hoppers 6, as shown in FIGS. 1 and 2. Alternatively, the collation may be formed by removing rows of cigarettes, corresponding to the transverse rows of the collation. For example, a collation of cigarettes for a container comprising two rows of ten cigarettes could be prepared using the apparatus of FIGS. 1 and 2, by inserting ten rows of two cigarettes into a split mandrel 22 positioned so that the shorter transverse axis of the mandrel is horizontal.

Figure 3:
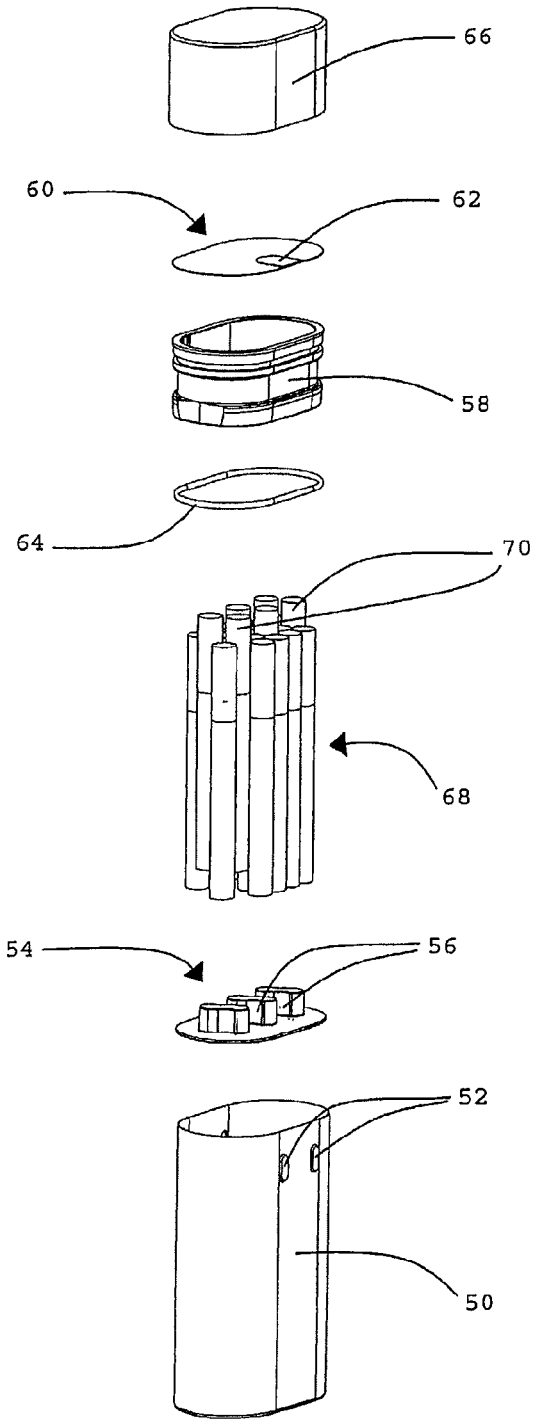
FIG. 3 shows an exploded perspective view of an embodiment of a preferred type of container for use with the apparatus of FIGS. 1 and 2.

Rather than being inserted into a collation mandrel, in embodiments of the method apparatus of the invention cigarettes removed from a reservoir in response to a customer order may be placed directly into a container. For example, with reference to the apparatus shown in FIGS. 1 and 2, rows of cigarettes could alternatively be pushed by the inserter rods from the channels of the hoppers 6 directly into pre-formed container bodies or lids held in pairs of hinged jaws mounted on the ends of the four arms 20 of the turret 16, in place of the split mandrels 22. Where sealing of the container under vacuum is not desired, direct insertion of the cigarettes into a container may be preferred An exploded view of an embodiment of a preferred type of container for use with the apparatus of FIGS. 1 and 2 is shown in FIG. 3. The container comprises a deep drawn, flat-bottom, cylindrical aluminium body 50 of oval cross-section. By oval here is meant a shape between rectangular and circular, having two parallel straight edges, the ends of which are joined by oppositely curved edges, that is, "stadium" shaped.

The body 50 is provided with a pair of elongate vertical protrusions 52 on the outer surface of each of its straight parallel sides, proximate the top thereof. In use, an injection moulded, laminar, polyethylene insert 54, having three spaced, apart, upwardly extending, elongate transverse steps 56 on its upper surface, is mounted within the body 50 on the base thereof, before the body 50 is placed in one of the additional magazines 36 of the apparatus of FIGS. 1 and 2

The container shown in FIG. 3 further comprises an injection moulded, high density polyethylene collar 58 having an oval cross-section of the same shape as the body 50, which, in use, is mounted within the body 50. A vertical barrier (not shown) extends longitudinally between the centres of the opposed curved ends of the collar 58, at the base thereof, dividing the interior of the collar 58 into two equally sized compartments.

In use, the compartments of the collar 58 receive two offset 4-6 nested collations of cigarettes from a split mandrel 22 having a central dividing blade mounted between the hinged jaws 24 thereof. The inner surface of the jaws 24 of the split mandrel 22, the sides of the vertical barrier and the inner surface of the collar 58 inline with the vertical barrier are profiled to match the two offset 4-6 collations of cigarettes.

An air and moisture impermeable, laminate, oval membrane 60 having a tab or flap 62 provided along a straight edge on its upper side is attached about its lower periphery to the upper edge of the collar 58 by, for example, heat sealing or permanent adhesive. An oval, nitrile rubber (NBR) O-ring 64 is mounted around the outside of the collar 58 towards the base thereof.

The container further comprises a deep drawn, flat-top, cylindrical aluminium lid 66 of oval cross-section, which, in use, fits over the upper end of the body 50 and rests on the protrusions 52.

In order to fill the container shown in FIG. 3 using the apparatus of FIGS. 1 and 2, the collar 58, with the membrane 60 and O-ring 64 pre-mounted thereon, may be placed membrane end first into the lid 66, and the lid 66 and collar 58 then loaded into a magazine 30 of the apparatus shown in FIGS. 1 and 2. Preferably, however, only the collar 58, with the membrane 60 and O-ring 64 pre-mounted thereon is loaded into the magazine 30, so that it is delivered membrane end down through an aperture 32 in the frame 4.

Cigarettes are pushed from the hoppers 6 into the split mandrel 22 to form the two offset 4-6 collations of cigarettes by the inserter rods as previously described. Preferably, the two rows of cigarettes on either side of the dividing blade of the split mandrel 22 are inserted from two different hoppers 6 mounted on the dispensing carousels 2 so that the two offset 4-6 collations formed in the split mandrel 22 contain different brands of cigarette.

After they have been formed, the two offset 4-6 collations of cigarettes are placed filter end down into the two compartments of the collar 58 at the second station of the turntable 26 and then the upside down body 50 dispensed from the additional magazine 36, with the insert 52 mounted therein, is placed over the them at the fourth station of the turntable as already described above.

Once the air within the vacuum chamber 40 at the fourth station has been evacuated, the body 50 is pushed down over the collar 58 until the upper edge of the body 50 is flush with the membrane 60. As the body 50 is pushed over the collar 58, the O-ring 64 mounted thereon creates a seal between the outer surface of the collar 58 and the inner surface of the body 50. Upon release of the vacuum inside the chamber 40, air is thus prevented from re-entering the body 50 of the container by the O-ring seal 64 and the impermeable membrane 60. In order to complete the container, additional means (not shown), provided downstream of the second horizontal gripper arm 48, places the lid 66 over the upper end of the upright body 50, so that it rests on the protrusions 52.

The self-sealing of the body 50 and the collar 58 of the container under vacuum maintains the freshness of the two offset 4-6 collations of cigarettes therein until the container is opened by the customer. To open the container, the customer first removes the lid 66 and then uses the tab or flap 62 provided on the upper surface of the membrane 60 to at least partially remove the membrane 60 from the top of the collar 58 to gain, access to the cigarettes 68 within the container. Advantageously, the membrane 60 is affixed to the top of the collar 58 using a re-sealable adhesive so that the customer may re-seal the container during use.

As shown in FIG. 3, three cigarettes 70 in each of the two offset 4-6 collations within the container are raised relative to other cigarettes therein by the steps 56 provided on the insert 54 mounted in the base of the body 50. Each step 56 raises two cigarettes 70, one from each 4-6 collation, which are disposed adjacent to one another in the collar 58 on opposite sides of the vertical barrier. In use, the six raised cigarettes 70 may be easily removed by the customer allowing the customer easy access to the cigarettes in each of the offset 4-6 collations. This is particularly advantageous where the two collations contain different brands of cigarette. It will be appreciated that steps or protrusions of different shape, size and/or position could be provided at the base of the body 50 to raise a different number and/or geometric arrangement of cigarettes within the container. It will also be appreciated that such steps or protrusions could, be provided, for example, by embossing the base of the body 50 rather than by the inclusion of a separate insert 54.

Containers of the preferred type for use with apparatus of the invention, exemplified by the container shown in FIG. 3, may have a variety of different shaped cross-sections, for example the cross-section may be square, rectangular, triangular or round, as well as "stadium" shaped. It will be appreciated that the size of containers of the preferred type for use with the apparatus of the invention may be varied to accommodate different numbers, collations and/or sizes of cigarette.

The body 50 and/or lid 66 of the container shown in FIG. 3, and of other embodiments of the preferred type of container for use with the apparatus of the invention, may be made from an injection moulded plastic instead of aluminium. Preferably, where the body and/or lid is made from plastic, a metal coating is applied to the outer surface thereof by, for example, metal vapour deposition. Where containers of the preferred type are made from aluminium, the thickness of the walls of the containers is preferably about 0.2 mm.

It will be appreciated from the foregoing description of the invention that preferred embodiments of the apparatus thereof provide an automated pack assembly with visual interest that allows the consumer to personalise their smoking selection in a unique, customised pack offer.

The invention claimed is:

1. A substantially air-tight customized container of cigarettes produced by:

providing a reservoir of cigarettes at a customer location;

automatically removing a pre-selected number of cigarettes from the reservoir in response to a customer order; and packing the removed pre-selected number of cigarettes into a container comprising a lid portion, a body portion and a collar having a substantially air and moisture impermeable membrane affixed to the upper surface thereof, the collar being mounted within the body- portion and surrounding the upper ends of the cigarettes in the container, wherein the collar is divided into two or more compartments.

2. A container according to claim 1 further comprising means mounted at the base of the body portion for raising the upper end of one or more of the cigarettes in the container relative to the upper ends of other cigarettes therein.

3. A container according to claim 1 comprising two or more different types of cigarette.

4. A container according to claim 3 wherein each of the compartments contains cigarettes of only one of the two or more different types.

5. A container according to claim 4 wherein the interior of the collar is divided into two or more compartments.

6. A container according to claim 1 wherein the membrane is affixed to'the collar by a re-sealable adhesive.

7. The container according to claim 1, wherein the container is sealed under partial vacuum.

8. The container according to claim 1, wherein the container is oval in cross-section.

9. The container according to claim 8, wherein the body and lid are made of aluminum.

10. The container according to claim 1, wherein the membrane is resealable and includes a pull tab.

11. A substantially air-tight, self-sealing container for use with apparatus for the production of a customized container of cigarettes at a customer location, the apparatus comprising:

a reservoir for storing cigarettes at the customer location;

a dispenser for automatically removing a pre-selected number of cigarettes from the reservoir at the customer location in response to a customer order;

computing means adapted to receive a customer order at the customer location and to transmit the customer order to the dispenser; and a packer for automatically packing the removed pre-selected number of cigarettes into a container at the customer location, the container comprising a lid portion, a body portion and a collar, mounted within the body portion, having a substantially air and moisture impermeable membrane affixed to the upper surface thereof, wherein the collar is divided into two or more compartments.

12. A container according to claim 11 further comprising an insert mounted at the base of the body portion raising the upper end of six cigarettes placed in the container relative to the upper ends of six other cigarettes in the group. the container is sealed under partial vacuum.

13. The container according to claim 11, wherein the container is sealed under partial vacuum.

* * * * *